US006619433B1

(12) United States Patent
Robert et al.

(10) Patent No.: US 6,619,433 B1
(45) Date of Patent: Sep. 16, 2003

(54) ELEVATOR SYSTEM USING MINIMAL BUILDING SPACE

(75) Inventors: Olivier Robert, Farmington, CT (US); Leandre Adifon, Farmington, CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/624,705

(22) Filed: Jul. 24, 2000

(51) Int. Cl.[7] ..... B66B 11/04

(52) U.S. Cl. ..... 187/251; 187/254; 187/262; 187/266; 187/258

(58) Field of Search ..... 187/251, 254, 187/262, 266, 258

(56) References Cited

U.S. PATENT DOCUMENTS

| | | | | | |
|---|---|---|---|---|---|
| 1,091,935 | A | * | 3/1914 | Laborda | 187/17 |
| 2,661,816 | A | * | 12/1953 | Hulsart | 187/8.41 |
| 2,694,467 | A | * | 11/1954 | Tupa | 187/17 |
| 3,066,761 | A | * | 12/1962 | Behrens et al. | 187/1 |
| 3,651,893 | A | * | 3/1972 | Berkovitz | 187/94 |
| 4,117,908 | A | * | 10/1978 | Nara et al. | 187/20 |
| 4,600,086 | A | * | 7/1986 | Yamasaki et al. | 187/27 |
| 4,949,815 | A | * | 8/1990 | Pavoz | 187/20 |
| 5,025,893 | A | * | 6/1991 | Saito | 187/20 |
| 5,076,398 | A | * | 12/1991 | Heikkinen | 187/20 |
| 5,127,493 | A | * | 7/1992 | Yasuda et al. | 187/94 |
| 5,226,507 | A | * | 7/1993 | Kawarasaki | 187/20 |
| 5,469,936 | A | * | 11/1995 | Lauga et al. | 187/205 |
| 5,509,503 | A | * | 4/1996 | Salmon | 187/266 |
| 5,626,207 | A | * | 5/1997 | Nichols | 187/263 |
| 5,944,144 | A | * | 8/1999 | Hein | 187/254 |
| 6,006,865 | A | * | 12/1999 | Ammon | 187/266 |
| 6,193,017 | B1 | * | 2/2001 | Koster | 198/258 |
| 6,193,018 | B1 | * | 2/2001 | Schroder-Brumloop et al. | 187/266 |
| 6,302,239 | B1 | * | 10/2001 | Honda | 187/254 |

FOREIGN PATENT DOCUMENTS

| | | | |
|---|---|---|---|
| DE | 1 084 001 | | 6/1960 |
| EP | 0 905 081 | A2 | 3/1999 |
| FR | 2 109 047 | A | 5/1972 |
| JP | 2000-177949 | | 6/2000 |
| JP | 02000351552 | A * | 12/2000 |
| JP | 2001063934 | | 3/2001 |
| WO | 99/43596 | | 9/1999 |

* cited by examiner

*Primary Examiner*—Kenneth W. Noland
*Assistant Examiner*—Rashmi Sharma

(57) ABSTRACT

An elevator system includes a hoistway having a vertically adjacent structural platform, i.e., a roof slab or pit slab, that includes a recess, and a machine that fits within the recess. The vertically adjacent structural platform defines either the ceiling or floor of the hoistway. As a result of having the machine tucked into the recess in the hoistway, the machine is removed from the hoistway and the hoistway need not be expanded, either horizontally or vertically, to accommodate the machine.

22 Claims, 4 Drawing Sheets

FIG. 1
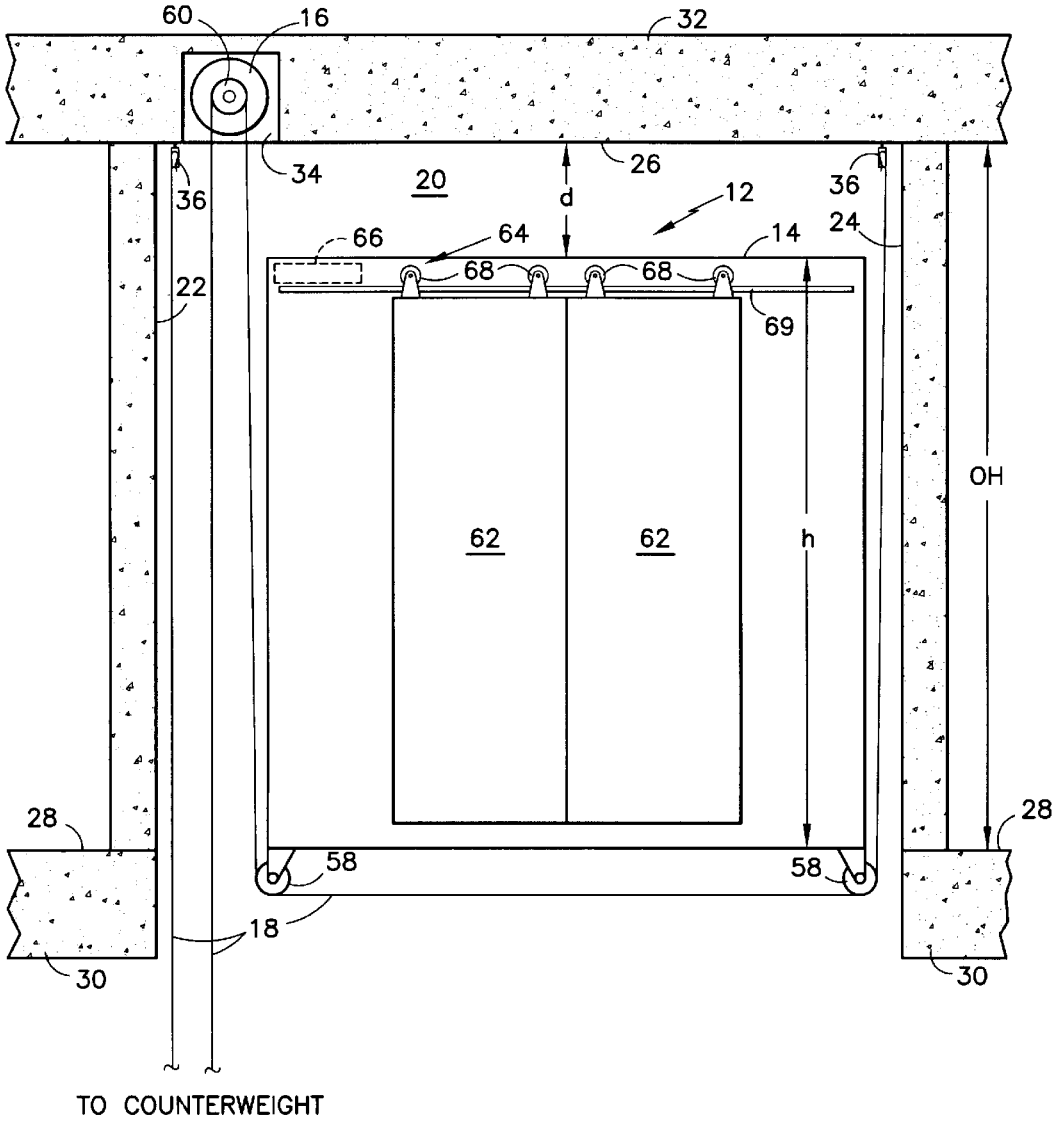
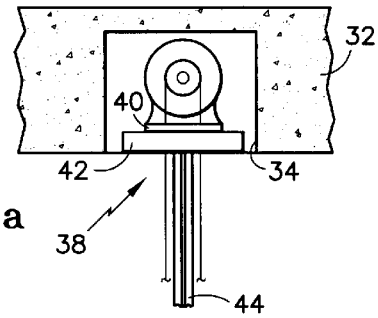
FIG.2a
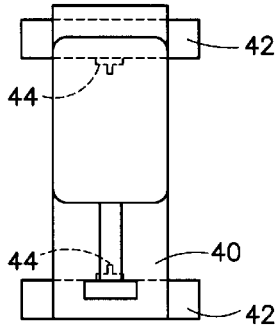
FIG.2b

FIG.3
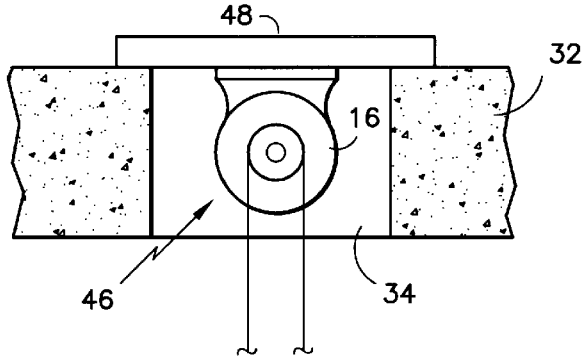
FIG.4a
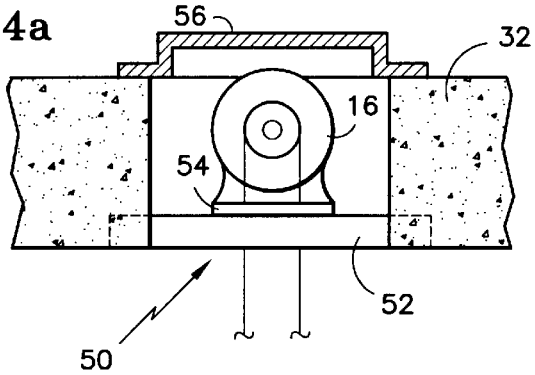
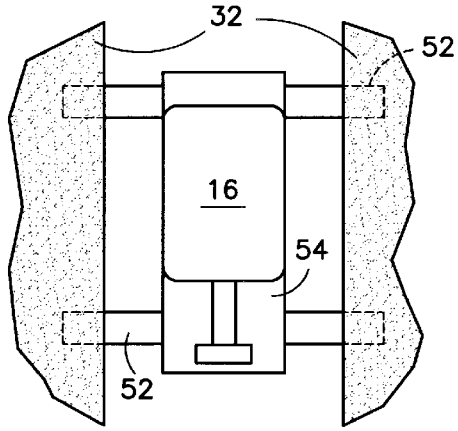
FIG.4b
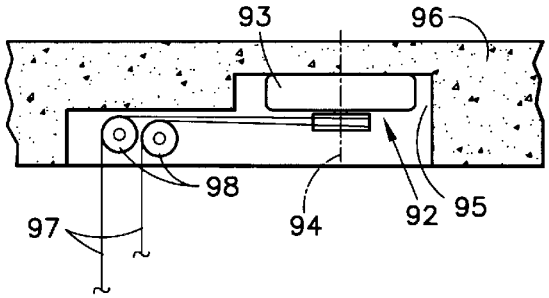
FIG.7

ELEVATOR SYSTEM USING MINIMAL BUILDING SPACE

TECHNICAL FIELD

The present invention relates to elevator systems, and more particularly to elevator systems without a separate machineroom.

BACKGROUND OF THE INVENTION

A typical traction elevator system includes a car and a counterweight disposed in a hoistway, a plurality of ropes that interconnect the car and counterweight, and a machine having a traction sheave engaged with the ropes. The ropes, and thereby the car and counterweight, are driven by rotation of the traction sheave. The machine, and its associated electronic equipment, along with peripheral elevator components, such as a governor, are housed in a separate machineroom located above, adjacent or proximate to the hoistway.

A recent trend in the elevator industry is to eliminate the separate machineroom and locate the various elevator equipment and components in an expanded hoistway. An example is JP 4-50297, which discloses the use of a machine located between the car travel space and a wall of the hoistway. The embodiment disclosed in this document requires the cross-sectional area of the hoistway to be expanded in order to fit the machine.

Another example of such an elevator is U.S. Pat. No. 5,429,211, which discloses the use of a machine located in the same position but having a motor with a disc-type rotor. This configuration makes use of the flatness of such a machine to minimize the expansion of the cross-sectional space needed for the machine in the hoistway. These types of machines, however, are limited to relatively low duties and low speeds.

In practice, these types of elevators also require a vertical extension of the hoistway in order to fit the machine and other equipment. Both of these configurations can add to the construction cost of installing the elevator system. In addition, placing the machine and other typical machineroom equipment in the hoistway requires special procedures and precautions to be taken in order to service the equipment.

The above art notwithstanding, scientists and engineers under the direction of Applicants' Assignee are working to develop elevator systems that efficiently utilize the available space within a building.

DISCLOSURE OF THE INVENTION

According to one embodiment of the present invention, an elevator system includes a hoistway having a vertically adjacent structural platform that includes a recess, and a machine that fits within the recess. The vertically adjacent structural platform defines either the ceiling or floor of the hoistway.

As a result of having the machine tucked into the recess in the hoistway, the machine is removed from the hoistway and the hoistway need not be expanded, either horizontally or vertically, to accommodate the machine. This reduces the space required for the hoistway to an amount sufficient to accommodate the car, counterweight, guide rails and ropes.

According to a particular embodiment of the present invention, the machine is a traction machine and the elevator system uses flat ropes as the suspension and traction ropes for the car and counterweight. This embodiment is particularly advantageous since the use of flat ropes minimizes the traction sheave diameter and, correspondingly, the size of the machine. In practice, the machine diameter may be in the range of 200–300 mm. Since most roof slabs in buildings have a depth of 200–300 mm, the machine in this embodiment may be fit within a recess in the roof slab in many buildings without requiring an extension above the roof of the building.

A principal feature of the present invention is the use of flat ropes. Flat rope, as used herein, is defined to include ropes having an aspect ratio, defined as the ratio of width w relative to thickness t, substantially greater than one. A more detailed description of an example of such ropes is included in commonly owned co-pending U.S. patent applications Ser. No. 09/031,108, entitled "Tension Member for an Elevator", filed Feb. 26, 1998, and Ser. No. 09/218,990, entitled "Tension Member for an Elevator", filed Dec. 22, 1998, both of which are incorporated herein by reference.

According to a further embodiment of the present invention, the elevator system includes ropes that engage with sheaves on the car such that the ropes pass under the car, and a compact door operator that is disposed below the roof line of the car. This embodiment permits the car to be raised to a height (including minimal safety distances) within the hoistway such that the roof of the car is immediately adjacent to the ceiling of the hoistway. The advantage of this embodiment is that the vertical distance between the top floor landing and the ceiling of the hoistway is minimized. In practice, with a conventional car height of approximately 2.2 meters, the top floor landing to hoistway ceiling distance (hereinafter referred to as "overhead") can be between 2.5 and 2.8 meters. This arrangement provides a further benefit for the design and construction of the building as it permits every floor of the building to be the same height, i.e., 2.5–2.8 meters.

The foregoing and other objects, features and advantages of the present invention become more apparent in light of the following detailed description of the exemplary embodiments thereof, as illustrated in the accompanying drawings.

BRIEF DESCRIPTION OF THE DRAWINGS

FIG. 1 is an illustrative representation of an elevator system according to the present invention.

FIGS. 2*a* and 2*b* are side and top views, respectively, a mounting arrangement for the elevator machine.

FIG. 3 is a side view of an alternate mounting arrangement for the elevator machine.

FIGS. 4*a* and 4*b* are side and top views, respectively, of another mounting arrangement for the elevator machine.

In FIG. 6*a*, the ropes are engaged with sheaves mounted above the car. In FIG. 6*b*, the ropes are directly attached to the car.

FIG. 7 is a further embodiment of the elevator system. In this embodiment, the machine includes a flat, disc-type motor and is mounted such that the ropes extend from the machine in a horizontal orientation.

BEST MODE FOR CARRYING OUT THE INVENTION

Figure 5:
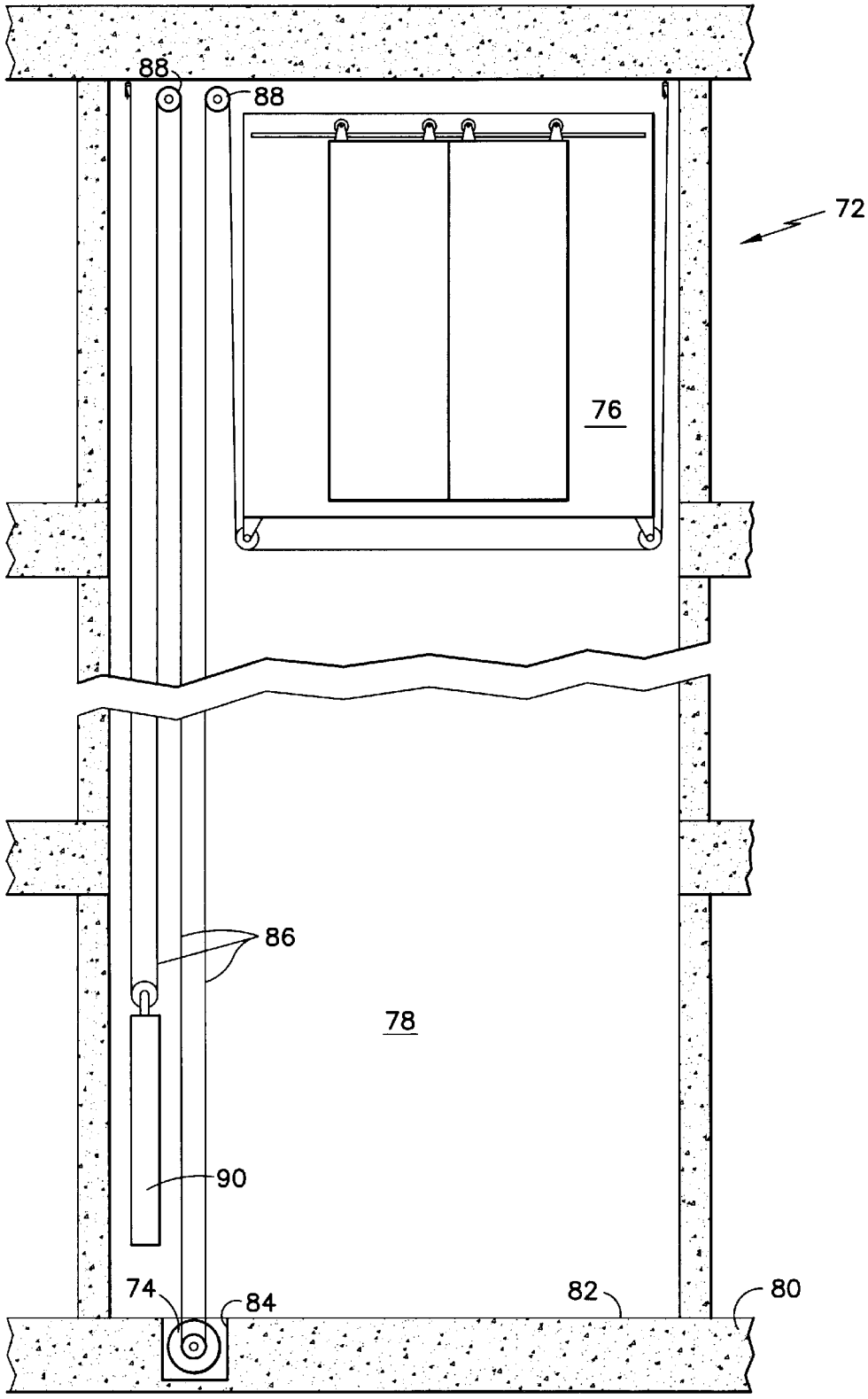
FIG. 5 is an alternate embodiment of the elevator system having the machine located below the car travel path.

An elevator system 12 according to the present invention is illustrated in FIG. 1. The elevator system includes a car 14, a machine 16, a counterweight (not shown), and one or more ropes 18 interconnecting the car 14 and counterweight. The car 14 travels through a hoistway 20 defined by walls 22, 24 and ceiling 26. Although not illustrated in FIG. 1 for clarity purposes, the car 14 and counterweight travel along guide surfaces such as conventional guide rails.

The hoistway 20 extends vertically along each landing 28 in the building. Each landing 28 includes a structural platform or slab 30. The roof of the building is another structural platform or slab 32, which defines the ceiling 26 of the hoistway 20. The ceiling 26 of the hoistway 20 is the uppermost point of travel of the car 14. The roof slab 32 includes a recess 34 that extends upward from the ceiling 26. This recess 34 is sized to receive the machine 16. In addition, terminations 36 for the ropes 18 are attached to the roof slab 32.

The machine 16 is located in the recess 34 in the roof slab 32. The ropes 18 extend downward from the machine 16 to engage the car 14 and counterweight. As a result of the machine 16 being disposed within the roof slab recess 34 and substantially above the ceiling 26, the machine 16 is not in, or adjacent to, the travel path of the car 14. This feature minimizes the horizontal cross-sectional area required by the elevator system 12. Further, the car 14 travel path is permitted to extend up to the ceiling 26 of the hoistway 20 such that no additional overhead space OH is required above the car 14 other than the space necessary for the movement of the car 14 itself, which includes a safety distance.

One type of car mounting arrangement is shown in FIGS. 2*a* and 2*b*. This mounting arrangement 38 comprises a bedplate 40 that supports the machine 16. The bedplate 40 is supported by a pair of beams 42 that are fixed to the counterweight rails 44. As a result, the loads of the machine 16 are transferred to the pit of the hoistway 20.

Another mounting arrangement is illustrated in FIG. 3. The mounting arrangement 46 includes a mounting beam or platform 48 disposed above the recess 34 and engaged with the top of the roof slab 32. The machine 16 is suspended from the beam 48. As a result of the beam 48 being above the recess 34, the recess 34 extends completely through the roof slab 32.

A further mounting arrangement 50 is shown in FIGS. 4*a* and 4*b*. This mounting arrangement includes a pair beams 52 supporting a bedplate 54. The machine 16 sits on the bedplate 54. The beams 52 are fixed to the roof slab 32 such that the loads of the machine 16 are transferred to the building. As with the previous mounting arrangement shown in FIG. 3, this arrangement may require the recess 34 to extend completely through the roof slab 32. As a result, a cover 56 may be used to seal the recess 34 from environmental interference.

Referring back to FIG. 1, the ropes 18 are engaged with the car 14 in a 2:1 roping configuration by a pair of idler sheaves 58 located on the bottom of the car 14, i.e., in a conventional underslung fashion. This type of 2:1 roping arrangement provides the benefits of reducing the torque requirements and increasing the rotational speed of the motor, and thereby minimizing the required output and size of the machine 14. As a result, less space is required for the recess 34. In addition, having the sheaves 58 located on the bottom of the car 14 further minimizes the amount of travel and overhead space required above the car 14 at the top of the hoistway 20.

In the preferred embodiment, the ropes 18 are flat ropes. The use of flat ropes 18 minimizes the size of the sheaves 58 engaged with the ropes 18. For the machine 16, this means that the traction sheave 60 diameter is minimized and therefore the torque requirements of the machine 16 are minimized. As a result, the machine 16 may be very compact and require minimal space for the recess 34. In addition, the idler sheaves 58 may also be minimized, which will reduce the space required for the car 14 and counterweight and also the cross-sectional area of the hoistway 20. Although this embodiment uses flat ropes to suspend and drive the elevator system 12, it should be noted that other types of ropes may also be used, such as conventional round ropes formed from steel or non-metallic materials.

The car 14 includes a pair of center opening doors 62 and a door operating system 64. Although illustrated in FIG. 1 as center opening doors, other door systems may also be used with the present invention, such as side opening doors and/or telescoping door systems. As shown in FIG. 1, the door operating system 64 includes an electronic control system 66 and a plurality of motorized door rollers 68 that are engaged with a door guide rail 69. The use of such a compact door operating system 64 permits the roof of the car 14 to remain clear of equipment, such as convention door operators that are mounted to the roof of typical elevator cars. Although shown as having motorized rollers 68, other compact door systems could be used with the invention, such as motorized pulleys mounted on the car and engaged with the doors via a traction cord, or linear motor door systems. In addition, conventional door operating systems could be used with the present invention if additional overhead space is available. Further, the door operating system could also be mounted on the bottom of the car if sufficient travel space is available in the bottom of the hoistway for such an arrangement.

The effect of having the machine 16 located within the recess 34 in the roof slab 32 is to minimize the amount of vertical space or overhead OH required between the roof slab 32 and the upper most landing slab 28. This distance OH can be limited to the vertical height b of the car 14 and the necessary amount of safety distance d of the car 14 required for safe operation of the elevator system 12. Although the amount of safety distance d for the car 14 may vary slightly depending on the applicable safety code, it is typically the sum of the car jump (a function of car speed), permissible overtravel of the car (approximately 50 mm), and counterweight buffer stroke, which is the maximum amount of vertical movement of the counterweight buffer when it is engaged by the counterweight. For cars traveling at approximately 1 meter/second, the amount of car safety distance d required is typically about 300 mm.

For example, conventional cars have a height h of approximately 2.2 meters. The total overhead OH required between the top landing slab 28 and the ceiling 26 of the hoistway 20 for safe operation of the elevator system 12 described above is about 2.5 meters. The magnitude of this distance OH is commercially significant because conventional floor spacing in a residential use type building is also about 2.5 meters. In office use type buildings, the spacing between floors is greater, typically on the order of about 2.8 meters. As a result, the floor spacing in either type building having the inventive elevator system may be uniform throughout the building. This feature provides enhanced flexibility to the architect or builder and costs savings to the building owner, as they are no longer required to accommodate additional vertical space for the top floor. In addition, since the machine is not located in the hoistway or horizontally adjacent to the travel path of the car, the cross-sectional space required for the elevator system is also minimized, which further reduces the costs of the building construction.

FIG. 5 illustrates an alternate configuration for the present invention. In this elevator system 72, the machine 74 is located below the travel path of the car 76. As shown in FIG. 5, the hoistway 78 includes a foundation or pit slab 80 that defines a floor 82 of the hoistway 78 and has a recess 84. The machine 74 is disposed within the recess 84 such that it is below the travel path of the car 76. The ropes 86 extend upward from the machine 74 to engage a pair of sheaves 88 mounted at the top of the hoistway 78. From there, the ropes 86 extend downward to engage the car 76 and counterweight 90. Although this configuration will require additional roping and sheaves as compared to the embodiment of FIG. 1, it will accomplish the objective of minimizing the vertical space requirements of the hoistway.

Figure 6A:
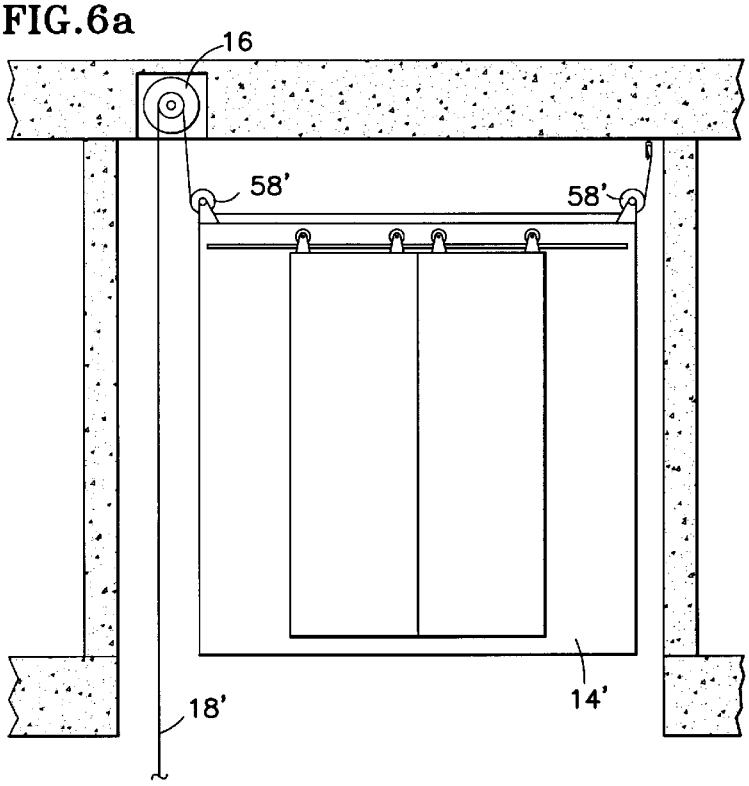
FIGS. 6*a* and 6*b* are alternate roping arrangements of the elevator system.
Figure 6B:
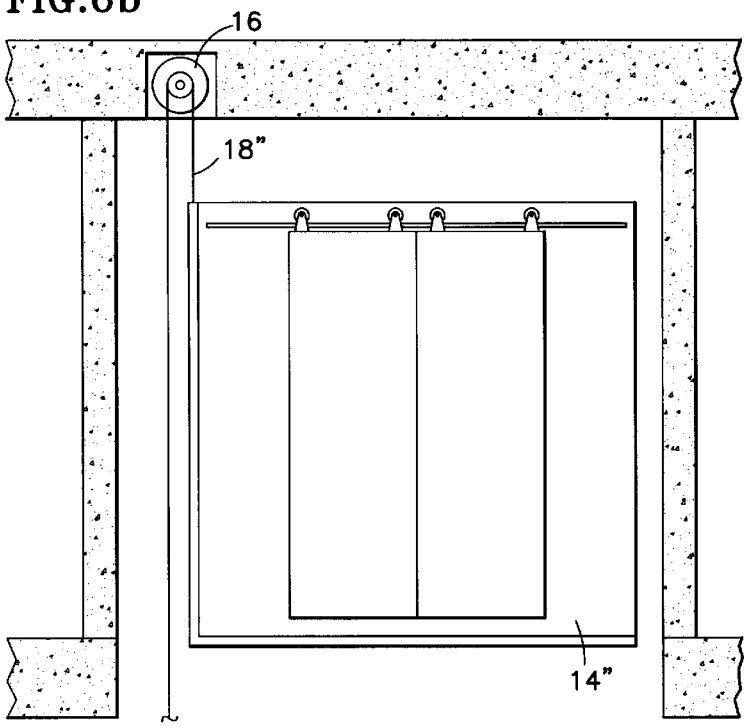

FIGS. 6*a* and 6*b* illustrate alternate roping configurations for the elevator system of the present invention. In FIG. 6*a*, the ropes 18' are engaged with the car 14' in a 2:1 manner as in FIG. 1, however the idler sheaves 58' on the car 14' are disposed on the roof of the car 14', i.e., the car 14' is overslung. Although this arrangement will require more space above the car 14' than the embodiment of FIG. 1, this additional space may be minimized by the use of flat ropes to minimize the diameters of the idler sheaves 58'. In FIG. 6*b*, the ropes 18" are directly attached to the car 14". This embodiment removes the idler sheaves completely from the car, although it will increase the output requirements of the machine 16 as compared to FIG. 1.

Illustrated in FIG. 7 is another embodiment of the present invention. In this embodiment, a machine 92 having a disc-type motor 93 is used to minimize the depth of the machine 92 as measured along its rotational axis 94. As a result, the machine 92 is positioned such that it's rotational axis 94 is vertically oriented and mounted within a recess 95 in the roof slab 96. Due to the orientation of the machine 92, the ropes 97 extend horizontally outward from the machine 92 and therefore a pair of idler sheaves 98 are engaged with the ropes 97 to direct them down to the car and counterweight (not shown). As shown in FIG. 7, the idler sheaves 98 are also located within the roof slab recess 95.

Although the invention has been shown and described with respect to exemplary embodiments thereof, it should be understood by those skilled in the art that various changes, omissions, and additions may be made thereto, without departing from the spirit and scope of the invention. For instance, although illustrated in the figures as a traction machine, other types of machines may be used with the invention, such as drum machines or hydraulic systems.

What is claimed is:

1. An elevator system including:

a hoistway including a substantially horizontal upper structural platform, the upper structural platform having a substantially horizontal surface defining the top of the hoistway, and the structural platform including a recess extending upward from the surface;

a car;

one or more ropes engaged with the ear;

a machine driving a traction sheave that is engaged with the ropes, the machine disposed within the recess and substantially above the surface.

2. The elevator system according to claim 1, further including a bedplate to support the machine, and wherein the bedplate is attached to the upper structural platform.

3. The elevator system according to claim 2, wherein the bedplate is disposed within the recess.

4. The elevator system according to claim 1, wherein the one or more ropes are attached to the car.

5. The elevator system according to claim 1, wherein the car includes one or more idler sheaves, and wherein the one or more ropes are engaged with the one or more idler sheaves.

6. The elevator system according to claim 5, wherein the one or more idler sheaves are disposed such that the ropes pass under the car.

7. The elevator system according to claim 5, wherein the one or more idler sheaves are disposed such that the ropes pass above the car.

8. The elevator system according to claim 1, further including one or more guide members extending through the hoistway, wherein the car is engaged with the guide members to guide the car during travel, and wherein the machine is supported by the one or more guide members.

9. The elevator system according to claim 8, further including a bedplate to support the machine, and wherein the bedplate attached to the one or more guide members.

10. The elevator system according to claim 1, wherein the one or more ropes includes flat ropes.

11. The elevator system according to claim 1, wherein the one or more ropes includes ropes having load-carrying strands formed from non-metallic materials.

12. The elevator system according to claim 1, wherein the upper structural member includes an upper surface that defines a roof.

13. The elevator system according to claim 1, wherein the upper structural member includes an upper surface and has a thickness less than or equal to 300 mm, wherein thickness is measured from the surface defining the top of the hoistway to the upper surface, and wherein the machine fits within the thickness of the upper structural member.

14. The elevator system according to claim 1, wherein the one or more ropes are engaged with the car in a manner providing balanced lifting forces on the car.

15. The elevator system according to claim 1, wherein the one or more ropes are engaged with the car in a manner providing unbalanced lifting forces on the car.

16. The elevator system according to claim 1, further including one or more guide members extending through the hoistway, wherein the car is engaged with the guide members to guide the car during travel, wherein the hoistway includes a wall, and wherein the one or more guide rails are disposed along the wall of the hoistway such that the car is guided in a cantilever manner.

17. The elevator system according to claim 1, wherein the machine is a disc type machine.

18. The elevator system according to claim 17, wherein the ropes extend in a horizontal orientation from the machine.

19. An elevator system including:

a hoistway extending through a building, the hoistway including a plurality of spaced landings, including a top landing, the hoistway including a substantially horizontal upper structural platform, the upper structural platform having a substantially horizontal surface defining the top of the hoistway, wherein the distance between the top landing and the top of the hoistway is substantially equal to the distance between one or more of the other adjacent landings;

a car adapted to travel within the hoistway;

one or more ropes engaged with the car; and a machine driving a traction sheave that is engaged with the ropes, the machine disposed above the car and not completely above the upper structural platform.

20. The elevator system according to claim 19, wherein the upper structural platform includes a recess extending upward from the surface, and wherein the machine extends into the recess.

21. The elevator system according to claim 20, wherein the machine is disposed in a fixed position within the recess.

22. An elevator system including:

a hoistway including a substantially horizontal structural platform, the vertically adjacent structural platform having a substantially horizontal s defining a ceiling of the hoistway, and the platform including a recess extending from this surface and into the platform;

a car, a machine driving a traction sheave that is engaged with the car to move the car through the hoistway, wherein the machine is disposed within the recess and substantially not beyond the surface.

* * * * *